US007045490B2

(12) United States Patent
Shimomura et al.

(10) Patent No.: US 7,045,490 B2
(45) Date of Patent: May 16, 2006

(54) REFRIGERATING MACHINE OIL COMPOSITION

(75) Inventors: Yuji Shimomura, Yokohama (JP); Katsuya Takigawa, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 122 days.

(21) Appl. No.: 10/333,687

(22) PCT Filed: Jul. 18, 2001

(86) PCT No.: PCT/JP01/06241

§ 371 (c)(1),
(2), (4) Date: Jan. 23, 2003

(87) PCT Pub. No.: WO02/08365

PCT Pub. Date: Jan. 31, 2002

(65) Prior Publication Data

US 2003/0166478 A1 Sep. 4, 2003

(30) Foreign Application Priority Data

Jul. 24, 2000 (JP) ..... P2000-222758

(51) Int. Cl.
*C10M 105/42* (2006.01)
*C10M 129/78* (2006.01)

(52) U.S. Cl. ..... 508/304; 508/433; 508/436; 508/492; 508/496; 252/68

(58) Field of Classification Search ..... 252/67, 252/68; 508/304, 492
See application file for complete search history.

(56) References Cited

U.S. PATENT DOCUMENTS 6,228,282 B1 * 5/2001 Shimomura et al. ..... 252/68
6,231,782 B1 * 5/2001 Shimomura et al. ..... 252/68
6,355,186 B1 * 3/2002 Shimomura et al. ..... 252/68
6,667,285 B1 * 12/2003 Kawahara et al. ..... 508/485

FOREIGN PATENT DOCUMENTS

| | | |
|---|---|---|
| EP | 0 435 253 | 7/1991 |
| EP | 0 440 069 | 8/1991 |
| JP | 03-128991 | 5/1991 |
| JP | 09-221690 | 8/1997 |
| JP | 2001-49275 | 2/2001 |
| WO | WO 90/12849 | 11/1990 |
| WO | WO 97/21792 | 6/1997 |
| WO | WO 00/58425 | 3/1999 |
| WO | WO 00/58424 | 8/1999 |
| WO | WO 01/02517 | 8/1999 |
| WO | WO 00/58426 | 5/2000 |
| WO | WO 01/05740 | 7/2000 |

* cited by examiner

*Primary Examiner*—Ellen M. McAvoy
(74) *Attorney, Agent, or Firm*—Finnegan, Henderson Farabow, Garrett & Dunner, LLP

(57) ABSTRACT

A refrigerating machine oil composition according to the invention comprises an alicyclic polycarboxylic acid ester compound obtained from the following compounds (a) to (c):

(a) an alicyclic polycarboxylic acid having an alicyclic ring and two or more carboxyl groups, or its derivative, wherein at least two of the carboxyl groups are bonded to mutually adjacent carbon atoms on the alicyclic ring;

(b) a compound with two or more hydroxyl groups or its derivative; and (c) a compound with one hydroxyl group or its derivative.

It can be used together with HFC refrigerants and natural refrigerants such as carbon dioxide and hydrocarbons, to provide a satisfactory balance between all of the properties of lubricity, miscibility with refrigerants, heat and hydrolytic stability and electric insulating property.

5 Claims, No Drawings

REFRIGERATING MACHINE OIL COMPOSITION

TECHNICAL FIELD

The present invention relates to a refrigerating machine oil composition, and specifically it relates to a refrigerating machine oil composition comprising an alicyclic polycarboxylic acid ester compound.

BACKGROUND ART

In recent years, the issues of refrigerant substitution and refrigerating system efficiency improvement have been studied from the standpoint of minimizing ozone layer destruction and global warning. In the area of refrigerant substitutes, progress is being made in the substitution of HFCs (hydrofluorocarbons) for chlorine-containing refrigerants such as CFCs (chlorofluorocarbons) and HCFCs (hydrochlorofluorocarbons) On the other hand, since HFC refrigerants could be subject to restrictions in light of the problem of global warming, natural refrigerants such as carbon dioxide, ammonia and hydrocarbons are also being researched for applied use.

Efforts toward such refrigerant substitution are advancing in parallel with development of refrigerating machine oils for these substitute refrigerants. Refrigerating machine oils must satisfy a number of performance requirements including lubricity, miscibility with refrigerants, heat and hydrolytic stability, electric insulating property and low hygroscopicity, and therefore compounds satisfying these requirements are selected to match the type and purpose of use of each refrigerant. Examples of refrigerating machine oils used for HFCs include oxygen-containing compounds such as esters, ethers and carbonates that are miscible with the refrigerants, and alkylbenzenes which have inferior miscibility with the refrigerants but have excellent lubricity and heat and hydrolytic stability.

At the same time, efforts are being made to lower the viscosity of refrigerating machine oils with the goal of achieving higher efficiency of refrigerating systems. Known ester-based refrigerator oils include polyol esters obtained by reaction of aliphatic polyhydric alcohols and fatty acids, as disclosed in Japanese Translation Publication No. HEI 3-505602 (JP-A 3-505602) of International Publication for Patent Application and Japanese Patent Kokai (Laid-Open) Publication No. HEI 3-128991 (JP-A 3-128991), and for reduction of the viscosity of such ester-based refrigerating machine oils it has been found effective to select fatty acids with low carbon number alkyl groups for use in the raw material. However, fatty acids with lower alkyl groups generally produce the undesirable situation of low heat and hydrolytic stability of the obtained esters. On the other hand, fatty acids with high carbon number alkyl groups are selected in order to increase the viscosity of such esters, but this creates a problem in that sufficient miscibility with refrigerants cannot be achieved.

There are also known alicyclic polycarboxylic acid esters, such as disclosed in Japanese Patent Kokai (Laid-Open) Publication No. HEI 9-221690 (JP-A 9-221690), as ester-based refrigerating machine oils with excellent heat and hydrolytic stability, but those with a large number of carbon atoms in the terminal alkyl group at the ester site have insufficient miscibility with refrigerants, while those with a small number of carbon atoms in the terminal alkyl group have inferior heat and hydrolytic stability, as well as insufficient lubricity.

There has yet to be developed, therefore, an ester-based refrigerating machine oil that has a satisfactory balance of lubricity, heat and hydrolytic stability and refrigerant miscibility, while also satisfying the other required aspects of performance such as electric insulating property.

DISCLOSURE OF THE INVENTION

It is an object of the present invention, which has been accomplished in light of the aforementioned problems of the prior art, to provide a refrigerating machine oil composition which has a satisfactory balance of lubricity, refrigerant miscibility, heat and hydrolytic stability and electrical insulating property when used together with HFC refrigerants or natural refrigerants such as carbon dioxide and hydrocarbons.

As a result of diligent research aimed at achieving this object, the present inventors have completed the present invention upon finding that the aforementioned problems are solved by using an alicyclic polycarboxylic acid ester compound obtained from a specific acid component and a specific alcohol component.

Namely, the refrigerating machine oil composition of the invention comprises an alicyclic polycarboxylic acid ester compound obtained from the following compounds (a) to (c);

(a) an alicyclic polycarboxylic acid having an alicyclic ring and two or more carboxyl groups, or its derivative, wherein at least two of the carboxyl groups are bonded to mutually adjacent carbon atoms on the alicyclic ring;

(b) a compound with two or more hydroxyl groups or its derivative; and (c) a compound with one hydroxyl group or its derivative.

According to the invention, the number of carboxyl groups of compound (a) is preferably 2, and the number of hydroxyl groups of compound (b) is preferably 2.

Moreover, according to the invention, compound (c) is preferably a mixture of at least one type of monohydric alcohol selected from the group consisting of aliphatic monohydric alcohols of 1–5 carbons and at least one type of monohydric alcohol selected from the group consisting of aliphatic monohydric alcohols of 6–18 carbons.

In addition, the refrigerating machine oil composition of the invention preferably also comprises at least one selected from the group consisting of is phosphoric acid esters, acidic phosphoric acid esters, amine salts of acidic phosphoric acid ester, chlorinated phosphoric acid esters and phosphorous acid esters.

The refrigerating machine oil composition of the invention preferably further comprises at least one selected from the group consisting of phenylglycidyl ether-type epoxy compounds, alkylglycidyl ether-type epoxy compounds, glycidyl ester-type epoxy compounds, allyloxirane compounds, alkyloxirane compounds, alicyclic epoxy compounds, epoxidized fatty acid monoesters and epoxidized vegetable oils.

BEST MODE FOR CARRYING OUT THE INVENTION

A preferred mode for the present invention will now be explained in detail.

The refrigerating machine oil composition of the invention comprises an alicyclic polycarboxylic acid ester compound obtained from the following compounds (a) to (c);

(a) an alicyclic polycarboxylic acid having an alicyclic ring and two or more carboxyl groups, or its derivative, wherein at least two of the carboxyl groups are bonded to mutually adjacent carbon atoms on the alicyclic ring;

(b) a compound with two or more hydroxyl groups or its derivative; and (c) a compound with one hydroxyl group or its derivative.

The (a) alicyclic polycarboxylic acid or its derivative used as the acid component for the invention must comprise an alicyclic ring and at least 2 carboxyl groups (such compounds will hereunder be collectively referred to as compound (a), including alicyclic polycarboxylic acid derivatives). If only one carboxyl group is present, the refrigerant miscibility and heat and hydrolytic stability are insufficient. While there is no particular limit to the number of carboxyl groups, it is preferably no greater than 4, more preferably no greater than 3 and most preferably no greater than 2. If the number of carboxyl groups exceeds this range, the low temperature flow properties of the obtained alicyclic polycarboxylic acid ester compound tend to be inadequate.

Furthermore, at least 2 of the carboxyl groups of compound (a) according to the invention must be bonded to mutually adjacent carbon atoms on the alicyclic ring. Without 2 carboxyl groups bonded to mutually adjacent carbon atoms on the alicyclic ring, the obtained alicyclic polycarboxylic acid ester has insufficient heat and hydrolytic stability.

When compound (a) used for the invention is an alicyclic polycarboxylic acid there are no particular restrictions on the steric configuration of the carboxyl groups, and the orientation of the carboxyl groups bonded to the mutually adjacent carbon atoms on the alicyclic ring may be the cis-form or trans-form. Also, cis-forms alone or trans-forms alone may be used, or mixtures of both may be used. However, cis-forms are preferred from the standpoint of heat and hydrolytic stability, while trans-forms are preferred from the standpoint of both heat and hydrolytic stability and lubricity. When a mixture of cis-forms and trans-forms is used, the molar ratio is preferably from 20/80 to 80/20, more preferably from 25/75 to 75/25 and even more preferably from 30/70 to 70/30. If the molar ratio of cis-forms and trans-forms is within these ranges, it is possible to achieve both higher lubricity and superior heat and hydrolytic stability.

As alicyclic polycarboxylic acids according to the invention there may be mentioned cycloalkanepolycarboxylic acids, cycloalkenepolycarboxylic acids and the like having at least two carboxyl groups bonded to mutually adjacent carbon atoms on the alicyclic ring, and any of these may be used alone or in combinations of two or more types. Specific examples of alicyclic polycarboxylic acids with such a structure include 1,2-cyclohexanedicarboxylic acid, 4-cyclohexene-1,2-dicarboxylic acid, 1-cyclohexene-1,2-dicarboxylic acid, 3-methyl-1,2-cyclohexanedicarboxylic acid, 4-methyl-1,2-cyclobexanedicarboxylic acid, 3-methyl-4-cyclohexene-1,2-dicarboxylic acid, 4-methyl-4-cyclohexene-1,2-dicarboxylic acid, 1,2,4-cyclohexanetricarboxylic acid and 1,2,4,5-cyclohexanetetracarboxylic acid. Of these, 1,2-cyclohexanedicarboxylic acid, 3-methyl-1,2-cyclohexanedicarboxylic acid, 4-methyl-1,2-cyclohexanedicarboxylic acid, 1,2,4-cyclohexanetricarboxylic acid and 1,2,4,5-cyclohexanetetracarboxylic acid are preferred from the standpoint of low rise ill viscosity during use of the obtained alicyclic polycarboxylic acid ester compound under prolonged and severe conditions, while 4-cyclohexene-1,2-dicarboxylic acid, 1-cyclohexene-1,2-dicarboxylic acid, 4-methyl-1,2-cyclohexanedicarboxylic acid, 3-methyl-4-cyclohexene-1,2-dicarboxylic acid and 4-methyl-4-cyclohexene-1,2-dicarboxylic acid are preferred from the standpoint of low rise in total acid value during use under prolonged and severe conditions.

Also, compound (a) according to the invention may be an alicyclic polycarboxylic acid derivative such as an acid anhydride, ester or acid halide. As alicyclic polycarboxylic acid derivatives to be used for the invention there may be mentioned acid anhydrides, esters and acid halides of the compounds mentioned above in explanation of the alicyclic polycarboxylic acid.

There are no particular restrictions on the process for producing the alicyclic, polycarboxylic acid or its derivative, and any desired process may be employed. As a specific example, 4-cyclohexene-1,2-dicarboxylic acid may be obtained by reacting butadiene and maleic anhydride in a benzene solvent at 100° C.

Compound (b) which is one of the alcohol components used for the invention must have at least two hydroxyl groups. As such examples for compound (b) there may be mentioned polyhydric alcohols, polyhydric phenols, polyhydric aminoalcohols and their condensates, as well as compounds obtained by esterification of the hydroxyl groups of these compounds with lower carboxylic acids such as acetic acid (these will hereunder be collectively referred to as compound (b), including derivatives of compounds with 2 or more hydroxyl groups). Among these, the use of polyhydric alcohols or their condensates tends to improve the refrigerant miscibility, electrical insulating property and heat stability.

Polyhydric alcohols that may be suitably used for the invention preferably have 2–10 carbons and more preferably 2–8 carbons, and may include an ether bond in the molecule. As specific examples of such polyhydric alcohols there may be mentioned ethylene glycol, propylene glycol, butylene glycol, 1,3-butanediol, 1,4-butanediol, glycerin, neopentylglycol, trimethylolethane, trimethylolpropane, trimethylolbutane, pentaerythritol, 1,3,5-pentanetriol, sorbitol, sorbitan, isosorbide, sorbitolglycerin condensate, adonitol, arabitol, xylitol, mannitol, xylose, arabinose, ribose, rhamnose, glucose, fructose, galactose, mannose, sorbose, cellobiose, maltose, isomaltose, trehalose, sucrose, raffinose, gentianose, melezitose, methylglucoside and their partial etherified products.

Polyhydric alcohol condensates that may be suitably used for the invention are obtained by condensation of polyhydric alcohols with preferably 2–10 carbons and more preferably 2–8 carbons. From the standpoint of electrical properties and ease of production, the degree of condensation of such polyhydric alcohol condensates is preferably 2–10, and more preferably 2–5. As specific examples of polyhydric alcohol condensates with such a structure there may be mentioned diethylene glycol, triethylene glycol, tetraethylene glycol, pentaethylene glycol, dipropylene glycol, tripropylene glycol, tetrapropylene glycol, pentapropylene glycol, dibutylene glycol, tributylene glycol, tetrabutylene glycol, pentabutylene glycol, diglycerin, triglycerin, tetraglycerin, pentaglycerin, di(neopentylglycol), tri(neopentylglycol), tetra(neopentylglycol), penta(neopentylglycol), di(trimethylolethane), tri(trimethylolethane), tetra (trimethylolethane), penta(trimethylolethane), di(trimethylolpropane), tri(trimethylolpropane), tetra(trimethylolpropane), penta(trimethylolpropane), di(trimethylolbutane), tri(trimethylolbutane), tetra(trimethylolbutane), penta(trimethylolbutane), di(pentaerythritol), tri(pentaerythritol), tetra(pentaerythritol) and penta(pentaerythritol).

Compound (b) which is used as one of the alcohol components for the invention may be a derivative having the hydroxyl groups esterified by a lower carboxylic acid, as mentioned above. As such derivatives there may be suitably used acetic acid esters and propionic acid esters of the compounds mentioned above as polyhydric alcohols and polyhydric alcohol condensates.

Compound (c) which is used as the other alcohol component for the invention must have one hydroxyl group. As examples of the compound (c) there may be mentioned monohydric alcohols, monohydric phenols, monohydric aminoalcohols and these compounds having the hydroxyl groups esterified with lower carboxylic acids such as acetic acid (such derivatives will also be included hereunder as compound (c)). Preferred for use among these are straight chain monohydric alcohols of 3–18 carbons, branched chain monohydric alcohols of 3–18 carbons and monohydric cycloalcohols of 5–10 carbons. As such monohydric alcohols there may be mentioned, specifically, straight or branched chain propanols (including n-propanol, 1-methylethanol, etc.), straight or branched chain butanols (including n-butanol, 1-methylpropanol, 2-methylpropanol, etc.), straight or branched chain pentanols (including n-pentanol, 1-methylbutanol, 2-methylbutanol, 3-methylbutanol, etc.), straight or branched chain hexanols (including n-hexanol, 1-methylpentanoyl, 2-methylpentanol, 3-methylpentanol, etc.), straight or branched chain heptanols (including n-heptanol, 1-methylhexanol, 2-methylhexanol, 3-methylhexanol, 4-methylhexanol, 5-methylhexanol, 2,4-dimethylpentanol, etc.), straight or branched chain octanols (including n-octanol, 2-ethylhexanol, 1-methylpentanol, 2-methylheptanol, etc.), straight or branched chain nonanols (including n-nonanol, 1-methyloctanol, 3,5,5-trimethylhexanol, 1-(2'-methylpropyl)-3-methylbutanol, etc.), straight or branched chain decanols (including n-decanol, iso-decanol, etc.), straight or branched chain undecanols (including n-undecanol, etc.), straight or branched chain dodecanols (including n-dodecanol, iso-dodecanol, etc.), straight or branched chain tridecanols, straight or branched chain tetradecanols (including n-tetradecanol, iso-tetradecanol, etc.), straight or branched chain pentadecanols, straight or branched chain hexadecanols (including n-hexadecanol, iso-hexadecanol, etc.), straight or branched chain heptadecanols, straight or branched chain octadecanols (including n-octadecanol, iso-octadecanol, etc.), cyclohexanol, methylcyclohexanol, dimethylcyclohexanol, and the like.

It is particularly preferred to use as compound (c) a mixture of (c-I) at least one type of monohydric alcohol selected from the group consisting of aliphatic monohydric alcohols of 1–5 carbons, and (c-II) at least one type of monohydric alcohol selected from the group consisting of aliphatic monohydric alcohols of 6–18 carbons, in order to obtain sufficiently high heat and hydrolytic stability and lubricity, as well as superior miscibility with refrigerants. When only one type of alcohol or the aforementioned group (c-I) is used, the obtained alicyclic dicarboxylic acid ester compound exhibits inferior heat and hydrolytic stability, while also tending to have insufficient lubricity. When only one type of alcohol of the aforementioned group (c-II) is used, the obtained alicyclic dicarboxylic acid ester compound tends to have insufficient miscibility with refrigerants.

Moreover, the alicyclic dicarboxylic acid ester compound of the invention is preferably obtained using two or more different alcohols as compound (c), and it is particularly preferred to use both an alcohol component of (c-I) and an alcohol component of (c-II). Even when two or more different types only among alcohol components of (c-I) are used as compound (c), the obtained alicyclic dicarboxylic acid ester compound tends to have inferior heat and hydrolytic stability, as well as insufficient lubricity. Furthermore, even when two or more different types only from among alcohol components of (c-II) are used, the obtained alicyclic dicarboxylic acid ester compound tends to have insufficient miscibility with refrigerants.

As alcohol components of (c-I) there may be mentioned straight chain alcohols of 1–5 carbons and branched chain alcohols of 3–5 carbons, specific examples of which include methanol, ethanol, n-propanol, n-butanol, n-pentanol, iso-propanol, iso-butanol, sec-butanol and iso-pentanol. From the standpoint of lubricity, n-butanol and n-pentanol are preferred among these, while iso-butanol and iso-pentanol are preferred from the standpoint of heat and hydrolytic stability.

As alcohol components of (c-II) there may be mentioned straight chain alcohols of 6–18 carbons and branched chain alcohols of 6–18 carbons, specific examples of which include n-hexanol, n-heptanol, n-octanol, n-nonanol, n-decanol, n-undecanol, n-dodecanol, n-tetradecanol, n-hexadecanol, n-octadecanol, iso-hexanol, 2-methylhexanol, 1-methylheptanol, 2-methylheptanol, iso-heptanol, 2-ethylhexanol, 2-octanol, iso-octanol, 3,5,5-trimethylhexanol, iso-decanol, iso-tetradecanol, iso-hexadecanol, iso-octadecanol and 2,6-dimethyl-4-heptanol. From the standpoint of both lubricity and miscibility, n-heptanol, n-octanol, n-nonanol and n-decanol are preferred among these, while iso-heptanol, 2-ethylhexanol and 3,5,5-trimethylhexanol are preferred from the standpoint of both miscibility and heat and hydrolytic stability.

When a (c-I) component and a (c-II) component are used together there are no particular restrictions on the molar ratio of the (c-I) component and the (c-II) component, but it is preferably in the range of 1:99 to 99:1 in order to simultaneously satisfy the required lubricity, heat and hydrolytic stability and refrigerant miscibility. From a standpoint focused on the miscibility, this ratio is preferably in the range of 60:40 to 99:1, more preferably in the range of 70:30 to 99:1 and most preferably in the range of 80;20 to 99:1. From a standpoint focused on the heat and hydrolytic stability and lubricity, the ratio is preferably in the range of 1:99 to 60:40, more preferably in the range of 1:99 to 50:50 and most preferably in the range of 1:99 to 40:60.

Compound (c) used as an alcohol component according to the invention may be a derivative wherein the hydroxyl group is esterified with a lower carboxylic acid. As such derivatives there may be suitably used acetic acid esters and propionic acid esters of the compounds mentioned above in explanation of the monohydric alcohol.

According to the invention, the following combination of compounds (a'),(b') and (c') are preferred as compounds (a), (b) and (c).

(a') At least one selected froth the group consisting of 1,2-cyclohexanedicarboxylic acid, 4-cyclohexene-1,2-dicarboxylic acid and their acid anhydrides, esters and acid halides;

(b') At least one selected from the group consisting of ethylene glycol, propylene glycol, butylene glycol, glycerin, neopentyl glycol, diethylene glycol, dipropylene glycol, dibutylene glycol, diglycerin, dineopentyl glycol and their esters; and (c') at least one selected from the group consisting of n-butanol, n-pentanol, n-hexanol, n-heptanol, n-octanol, n-nonanol, n-decanol, iso-butanol, iso-pentanol, iso-hexanol, iso-heptanol, 2-ethylhexanol, 3,5,5-trimethylhexanol, mixed alcohols of n-butanol and n-hexanol, mixed alcohols of n-butanol and n-heptanol, mixed alcohols of n-butanol and n-octanol, mixed alcohols of n-butanol and n-nonanol, mixed alcohols of n-butanol and n-decanol, mixed alcohols of n-butanol and iso-hexanol, mixed alcohols of n-butanol and iso-heptanol, mixed alcohols of n-butanol and 2-ethylhexanol, mixed alcohols of n-butanol and 3,5,5-trimethylhexanol, mixed alcohols of iso-butanol and n-hexanol, mixed alcohols of iso-butanol and n-heptanol, mixed alcohols of iso-butanol and n-octanol, mixed alcohols of iso-butanol and n-nonanol, mixed alcohols of iso-butanol and n-decanol, mixed alcohols of iso-butanol and iso-hexanol, mixed alcohols of iso-butanol and iso-heptanol, mixed alcohols of iso-butanol and 2-ethylhexanol, mixed alcohols of iso-butanol and 3,5,5-trimethylhexanol, mixed alcohols of n-pentanol and n-hexanol, mixed alcohols of n-pentanol and n-heptanol, mixed alcohols of n-pentanol and n-octanol, mixed alcohols of n-pentanol and n-nonanol, mixed alcohols of n-pentanol and n-decanol, mixed alcohols of n-pentanol and iso-hexanol, mixed alcohols of n-pentanol and iso-heptanol, mixed alcohols of n-pentanol and 2-ethylhexanol, mixed alcohols of n-pentanol and 3,5,5-trimethylhexanol, mixed alcohols of iso-pentanol and n-hexanol, mixed alcohols of iso-pentanol and n-heptanol, mixed alcohols of iso-pentanol and n-octanol, mixed alcohols of iso-pentanol and n-nonanol, mixed alcohols of iso-pentanol and n-decanol, mixed alcohols of iso-pentanol and iso-hexanol, mixed alcohols of iso-pentanol and iso-heptanol, mixed alcohols of iso-pentanol and 2-ethylhexanol, mixed alcohols of iso-pentanol, 3,5,5-trimethylhexanol, and their esters.

The total amount of the alcohols of compound (b) and compound (c) for esterification reaction using the aforementioned compounds (a) to (c) is usually 1.0–1.5 equivalents and preferably 1.05–1.2 equivalents to one equivalent of the (a) alicyclic polycarboxylic acid or its anhydride.

The molar ratio of compound (b) and compound (c) is not particularly limited, but a range of 1:99 to 99:1 is preferred because it can simultaneously provide satisfactory lubricity, heat and hydrolytic stability and miscibility with refrigerants. From a standpoint focused on miscibility, the ratio is preferably in the range of 1:99 to 80:20, more preferably in the range of 5:95 to 70:30 and most preferably in the range of 10:90 to 60:40.

The alicyclic polycarboxylic acid ester compound of the invention is prepared by esterification of the acid component (a) and alcohol components (b) and (c) according to a common process, preferably in an inert gas atmosphere of nitrogen or the like, with heating either in the presence of or in the absence of an esterification catalyst.

When a lower alcohol ester of an alicyclic dicarboxylic acid is used as compound (a), or when an acetic acid ester or propionic acid ester of an alcohol is used as compound (b) or (c), it is possible to obtain an alicyclic dicarboxylic acid ester compound according to the invention by ester exchange reaction.

Examples of esterification catalysts for the esterification reaction include Lewis acids such as aluminum derivatives, tin derivatives and titanium derivatives; alkali metal salts such as sodium alkoxides and potassium alkoxides; and sulfonic acids such as para-toluenesulfonic acid, methanesulfonic acid and sulfuric acid, among which Lewis acids such as aluminum derivatives, tin derivatives and titanium derivatives are preferred in consideration of the effect on the heat and hydrolytic stability of the obtained alicyclic dicarboxylic acid ester compound, with tin derivatives being particularly preferred from the standpoint of reaction efficiency. The amount of esterifying catalyst used may be, for example, about 0.1–1% by mass with respect to the total of the acid component and alcohol component raw materials.

The reaction temperature for the esterification is typically 150–230° C., and the reaction is usually complete by 3 to 30 hours.

After completion of the esterification reaction, the excess raw materials are distilled off under reduced pressure or under ordinary pressure, and then a common purification method such as liquid/liquid extraction, reduced pressure distillation, or adsorption purification treatment such as active carbon treatment, may be employed to purify the ester compound.

When, for the esterification reaction, the polycarboxylic acid or its derivative used as compound (a) has two carboxyl groups and the compound used as compound (b) has two hydroxyl groups, the reaction product will generally encompass compounds represented by the following formulas (A) to (E):

$$R^2—X—R^1—X—R^2 \quad (A)$$

$$R^2—X—R^1—X—R^1—X—R^2 \quad (B)$$

(C)

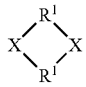

(D)

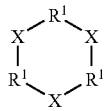

$$R^2—X—R^2 \quad (E)$$

where X represents an alicyclic dicarboxylic acid residue derived from compound (a), $R^1$ represents the residue of a compound with 2 hydroxyl groups derived from compound (b), and $R^2$ represents the residue of a compound with one hydroxyl group derived from compound (c).

The alicyclic dicarboxylic acid residues represented by X in formulas (A) to (E) above are groups wherein carboxyl groups are bonded to mutually adjacent carbon atoms on an alicyclic ring such as a cyclopentane ring, cyclopentene ring, cyclohexane ring, cyclohexene ring, cycloheptane ring or cycloheptene ring. Preferred for such alicyclic dicarboxylic acid residues are groups with cyclohexane rings and cyclohexene rings. Groups with cyclohexane rings are more preferred among these because of their low rise in viscosity during use under prolonged and severe conditions, while cyclohexene rings are even more preferred because of their low rise in total acid value during use under prolonged and severe conditions.

The groups represented by $R^1$ in formulas (A) to (E) above are residues of compounds with 2 hydroxyl groups used as compound (b), from which the hydroxyl groups have been removed.

When a dihydric alcohol is used as compound (b), $R^1$ may include an ether bond, and it preferably has 2–10 carbons and more preferably 2–8 carbons. As specific examples of $R^1$ there may be mentioned residues of compounds such as ethylene glycol, propylene glycol, butylene glycol, 1,3-butanediol, 1,4-butanediol and neopentylglycol with the hydroxyl groups removed.

When a condensate of a dihydric alcohol is used as compound (b), $R^1$ is preferably a residue of a condensate with 2–10 (preferably 2–8) carbons and a condensation degree of 2–10 (preferably 2–5). As specific examples of $R^1$ there may be mentioned residues of compounds such as diethylene glycol, triethylene glycol, tetraethylene glycol, pentaethylene glycol, dipropylene glycol, tripropylene glycol, tetrapropylene glycol, pentapropylene glycol, dibutylene glycol, tributylene glycol, tetrabutylene glycol, pentabutylene glycol, di(neopentylglycol), tri(neopentylglycol), tetra(neopentylglycol) and penta(neopentylglycol), with the hydroxyl groups removed.

The groups represented by $R^2$ in formulas (A) to (E) above are residues of compounds with one hydroxyl group used as compound (c), with the hydroxyl group removed. $R^2$ preferably has 1–30 carbons, more preferably 2–24 carbons and even more preferably 3–18 carbons. As groups for $R^2$ there may be mentioned alkyl groups, alkenyl groups, cycloalkyl groups, alkylcycloalkyl groups, aryl groups, alkylaryl groups and arylalkyl groups. Alkyl groups, cycloalkyl groups and alkylcycloalkyl groups are preferred among these from the standpoint of heat and hydrolytic stability.

Of the groups represented by $R^2$, the alkyl groups may be either straight or branched chain. As specific examples of alkyl groups of 3–18 carbons there may be mentioned straight or branched chain propyl group, straight or branched chain butyl group, straight or branched chain pentyl group, straight or branched chain hexyl group, straight or branched chain heptyl group, straight or branched chain octyl group, straight or branched chain nonyl group, straight or branched chain decyl group, straight or branched chain undecyl group, straight or branched chain octyl group, straight or branched chain tridecyl group, straight or branched chain tetradecyl group, straight or branched chain pentadecyl group, straight or branched chain hexadecyl group, straight or branched chain heptadecyl group and straight or branched chain octadecyl group.

Of these alkyl groups, straight chain alkyl groups of 4 or more carbons are preferred from the standpoint of heat and hydrolytic stability, while those of no greater than 18 carbons are preferred from the standpoint of refrigerant miscibility. Branched chain alkyl groups of 3 or more carbons are preferred from the standpoint of heat and hydrolytic stability, while those of no greater than 18 carbons are preferred from the standpoint of refrigerant miscibility.

As cycloalkyl groups represented by $R^2$ there may be mentioned cyclopentyl group, cyclohexyl group and cycloheptyl group, with cyclohexyl group being preferred from the standpoint of heat and hydrolytic stability. An alkylcycloalkyl group is one having an alkyl group bonded to a cycloalkyl group, and those with alkyl groups bonded to cyclohexyl are preferred from the standpoint of heat and hydrolytic stability. Preferred alkylcycloalkyl groups are also those with a total of 6 or more carbons from the standpoint of heat and hydrolytic stability, and those with no more than a total of 10 carbons from the standpoint of refrigerant miscibility and low temperature flow properties.

When a mixed alcohol of monohydric alcohols of (c-I) and (c-II) is used as compound (c), the alkyl group derived from component (c-I) of the $R^2$ groups of the obtained compounds (A) to (E) is an alkyl group of 1–5 carbons, and preferably an alkyl group of 3–5 carbons from the standpoint of beat and hydrolytic stability.

The alkyl group of 1–5 carbons derived from component (c-I) may be straight or branched chain, but straight chain alkyl groups are preferred from the standpoint of lubricity, while branched chain alkyl groups are preferred from the standpoint of refrigerant miscibility and heat and hydrolytic stability. As specific examples of such alkyl groups there may be mentioned methyl group, ethyl group, straight or branched chain propyl group, straight or branched chain butyl group, straight or branched chain pentyl group and the like, among which n-butyl group and n-pentyl group are preferred from the standpoint of lubricity, while iso-butyl group and iso-pentyl group are preferred from the standpoint of heat and hydrolytic stability.

The alkyl group derived from component (c-II) of the $R^2$ groups of the aforementioned compounds (A) to (E) is an alkyl group of 6–18 carbons, and from the standpoint of miscibility, it is preferably an alkyl group of 6–12 carbons and even more preferably an alkyl group of 7–9 carbons. An alkyl group of 6–18 carbons may be straight or branched chain, but straight chain alkyl groups are preferred from the standpoint of lubricity, while branched chain alkyl groups are preferred from the standpoint of miscibility and heat and hydrolytic stability. The alkyl group preferably has no more than 18 carbons as this results in inferior refrigerant miscibility and low temperature flow properties.

As specific examples of alkyl groups of 6–18 carbons derived from component (c-II) there may be mentioned straight or branched chain hexyl group, straight or branched chain heptyl group, straight or branched chain octyl group, straight or branched chain nonyl group, straight or branched chain decyl group, straight or branched chain undecyl group, straight or branched chain dodecyl group, straight or branched chain tridecyl group, straight or branched chain tetradecyl group, straight or branched chain pentadecyl group, straight or branched chain hexadecyl group, straight or branched chain heptadecyl group and straight or branched chain octadecyl group, among which n-heptyl group, n-octyl group, n-nonyl group arid n-decyl group are preferred from the standpoint of both lubricity and miscibility, while iso-heptyl group, 2-ethylhexyl group and 3,5,5-trimethylhexyl group are preferred from the standpoint of both miscibility and heat and hydrolytic stability.

When an alcohol of component (c-I) and an alcohol of component (c-II) are used for compound (c), the compounds represented by formulas (A), (B) and (E) above will include the following (I) to (III):

(I) Esters wherein one of the two alkyl groups represented by $R^2$ in the same molecule is a group derived from component (c-I) and the other is a group derived from component (c-II);

(II) Mixtures of esters wherein both ester groups represented by $R^2$ in the same molecule are groups derived from component (c-I) and esters wherein the two ester groups represented by $R^2$ in the same molecule are groups derived from component (c-II); and (III) Mixtures of (I) and (II).

According to the invention, any of the modes of (I) to (III) may be used, although (I) or (III) is preferred from the standpoint of heat and hydrolytic stability.

For (III), there is no particular limit on the proportion of (I) and (II), but from the standpoint of heat and hydrolytic stability, (I) is present at preferably 5% by mass or greater, more preferably 10% by mass or greater, even more preferably 15% by mass or greater and most preferably 20% by mass or greater, with respect to the total of (I) and (II).

For the $R^2$ groups in formulas (A), (B) and (E) there are no particular restrictions on the (molar) ratio of $R^2$ derived from an alcohol of component (c-I) and $R^2$ derived from an alcohol of component (c-II), but the range of 1:99 to 99:1 is preferred to simultaneously achieve satisfactory lubricity, heat and hydrolytic stability and refrigerant miscibility. From a standpoint focused on miscibility, this ratio is preferably in the range of 60:40 to 99:1, more preferably in the range of 70:30 to 99:1 and most preferably in the range of 80:20 to 99:1. From a standpoint focused on the heat and hydrolytic stability and lubricity, the ratio is preferably in the range of 1:99 to 60:40, more preferably in the range of 1:99 to 50:50 and most preferably in the range of 1:99 to 40:60.

According to the invention, when a compound obtained by the aforementioned esterification reaction is represented by any of formulas (A) to (E) above, one type of compound represented by formulas (A) to (D) may be used, or a mixture of two or more types of compounds represented by formulas (A) to (E) may be used. It is not highly preferred for the alicyclic polycarboxylic acid ester compound of the invention to contain none of the compounds represented by formulas (A) to (D), being composed only of compounds represented by formula E), because this results in a poor balance between viscosity rise arid refrigerant miscibility.

When the alicyclic polycarboxylic acid ester compound of the invention is a mixture of two or more different compounds represented by formulas (A) to (E), the proportion of each compound may be as desired and is not particularly restricted, but the contents based on the total mixture are preferably as follows, from the standpoint of balance between refrigerant miscibility and performance, as well as ease of production.

(A): 0–100 mol %, preferably 1–99 mol % and more preferably 5–95 mol %.

(B): 0–100 mol %, preferably 1–90 mol % and more preferably 2–80 mol %.

(C) 0–100 mol %, preferably 1–99 mol % and more preferably 5–95 mol %.

(D): 0–100 mol %, preferably 1–90 mol % and more preferably 2–80 mol %.

(E): 0–90 mol %, preferably 1–80 mol % and more preferably 5–75 mol %.

The foregoing explanation concerns esterification reaction using compound (a) as the acid component and compounds (b) and (c) as alcohol components, but an alicyclic polycarboxylic acid ester compound according to the invention is not limited to being produced by the aforementioned esterification reaction so long as the acid component structure in the molecule is derived front compound (a) and the alcohol component structure is derived from compound (b) and/or compound (c), For example, it is possible to obtain an aromatic polycarboxylic acid ester compound by esterification reaction between an aromatic polycarboxylic acid with two carboxyl groups on mutually adjacent carbon atoms of the aromatic ring, and alcohols of compound (b) and (c), and then to obtain the target alicyclic polycarboxylic acid ester compound by hydrogen addition (hydrogenation) of the obtained aromatic polycarboxylic acid ester.

In the alicyclic polycarboxylic acid ester compound obtained in this manner, hydrocarbon groups may of course be bonded to one or more of the carbon atoms of the alicyclic ring. Such hydrocarbon groups are preferably alkyl groups, with methyl group being particularly preferred in terms of miscibility.

While there are no particular restrictions on the content of the alicyclic polycarboxylic acid ester compound in a refrigerating machine oil composition according to the invention, it is preferably 5% by mass or greater, more preferably 10% by mass or greater, even more preferably 30% by mass or greater and most preferably 50% by mass or greater, based on the total amount of the refrigerating machine oil, as this will help to bring out the excellent performance of the alicyclic polycarboxylic acid ester compound.

The alicyclic polycarboxylic acid ester compound in the refrigerating machine oil composition of the invention is used primarily as a base oil. While the alicyclic polycarboxylic acid ester compound may be used alone as the base oil for the refrigerating machine oil composition of the invention, it may also be used in combination with oxygen-containing synthetic oils including esters other than the alicyclic polycarboxylic acid ester compound specified by the invention, such as polyol esters and complex esters, polyglycols, polyvinyl ethers, ketones, polyphenyl ethers, silicones, polysiloxanes arid perfluoroethers.

There are no particular restrictions on the amount of oxygen-containing synthetic oils included. From the standpoint of achieving improvement in thermal efficiency as well as heat and hydrolytic stability of the refrigerating machine oil, however, other oxygen-containing synthetic oils are preferably present at no greater than 150 parts by weight, and more preferably no greater than 100 parts by weight, to 100 parts by weight of the alicyclic polycarboxylic acid ester compound.

The refrigerating machine oil composition of the invention comprises an alicyclic polycarboxylic acid ester compound and if necessary oxygen-containing synthetic oils, and these are used primarily for the base oil. The refrigerating machine oil composition of the invention may also be suitably used with no further additives, or if necessary, it may be used in a form combined with various additives.

For further enhancement of the abrasion resistance and load resistance of the refrigerating machine oil composition of the invention, it preferably further includes at least one type of phosphorus compound selected from the group consisting of phosphoric acid esters, acidic phosphoric acid esters, amine salts of acidic phosphoric acid ester, chlorinated phosphoric acid esters and phosphorous acid esters. These phosphorus compounds are esters of phosphoric acid or phosphorous acid with alkanols and polyether alkanols, or derivatives thereof.

As specific examples of phosphoric acid esters there may be mentioned tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate and xylenyldiphenyl phosphate. As acidic phosphoric acid esters there may be mentioned monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate and dioleyl acid phosphate. As amine salts of acidic phosphoric acid ester there may be mentioned amine salts of the above acidic phosphoric esters and amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine and trioctylamine. As chlorinated phosphoric acid esters there may be mentioned tris dichloropropyl phosphate, tris chloroethyl phosphate, tris chlorophenyl phosphate and polyoxyalkylene bis[di(chloroalkyl)] phosphate. As phosphorous acid esters there may be mentioned dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. Mixtures of these may also be used.

When such phosphorus compounds are added to the refrigerating machine oil composition of the invention there are no particular restrictions on their content, but such phosphorus compounds will usually be added to a content of 0.01–5.0% by mass and preferably 0.02–3.0% by mass, based on the total of the refrigerating machine oil composition (based on the total of the base oil and all additives).

For enhanced heat and hydrolytic stability of the refrigerating machine oil composition of the invention, there may also be included one or more epoxy compounds selected from the group consisting of the following (i) to (viii ):

(i) phenylglycidyl ether-type epoxy compounds
(ii) alkylglycidyl ether-type epoxy compounds
(iii) glycidyl ester-type epoxy compounds
(iv) allyloxirane compounds
(v) alkyloxirane compounds
(vi) alicyclic epoxy compounds
(vii) epoxidized fatty acid monoesters
(viii) epoxidized vegetable oils Specific examples of (i) phenylglycidyl ether-type epoxy compounds include phenylglycidyl ethers and alkylphenylglycidyl ethers. Here, the alkylphenylglycicyl ethers may have 1–3 alkyl groups of 1–13 carbons, among which preferred examples include those with one alkyl group of 4–10 carbons, such as n-butylphenylglycidyl ether, i-butylphenylglycidyl ether, sec-butylphenylglycidyl ether, tertbutylphenylglycidyl ether, pentylphenylglycidyl ether, hexylphenylglycidyl ether, heptylphenylglycidyl ether, octylphenylglycidyl ether, nonylphenylglycidyl ether and decylphenylglycidyl ether.

Specific examples of (ii) alkylglycidyl ether-type epoxy compounds include decylglycidyl ether, undecylglycidyl ether, dodecylglycidyl ether, tridecylglycidyl ether, tetradecylglycidyl ether, 2-ethylhexylglycidyl ether, neopentylglycoldiglycidyl ether, trimethylolpropane triglycidyl ether, pentaerythritol tetraglycidyl ether, 1,6-hexanediol diglycidyl ether, sorbitolpolyglycidyl ether, polyalkyleneglycol monoglycidyl ether and polyalkyleneglycol diglycidyl ether.

Specific examples of (iii) glycidyl ester-type epoxy compounds include compounds represented by the following general formula (1):

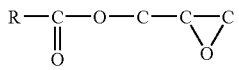

(1)

where R represents a hydrocarbon group of 1–18 carbons.

In formula (1) above, R represents a hydrocarbon group of 1–18 carbons, and as such hydrocarbon groups there may be mentioned alkyl groups of 1–18 carbons, alkenyl groups of 2–18 carbons, cycloalkyl groups of 5–7 carbons, alkylcycloalkyl groups of 6–18 carbons, aryl groups of 6–10 carbons, alkylaryl groups of 7–18 carbons and arylalkyl groups of 7–18 carbons. Preferred among these are alkyl groups of 5–15 carbons, alkenyl groups of 2–15 carbons, phenyl groups and alkylphenyl groups with alkyl groups of 1–4 carbons.

Specific preferred examples among these glycidyl ester epoxy compounds include glycidyl-2,2-dimethyl octanoate, glycidyl benzoate, glycidyl-tert-butyl benzoate, glycidyl acrylate, glycidyl methacrylate and the like.

Specific examples of (iv) allyloxirane compounds include 1,2-epoxystyrene and alkyl-1,2-epoxystyrene.

Specific examples of (v) alkyloxirane compounds include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxydecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1,2-epoxyoctadecane, 2-epoxynonadecane and 1,2-epoxyeicosane.

As (vi) alicyclic epoxy compounds there may be mentioned compounds wherein carbon atoms composing the epoxy group are directly part of the alicycle, such as compounds represented by the following general formula (2):

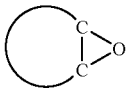

(2)

Specific examples of such alicyclic epoxy compounds include 1,2-epoxycyclohexane, 1,2-epoxycyclopentane, 3,4-epoxycyclohexylmethyl-3,4-epoxycyclohexane carboxylate, bis(3,4-epoxycyclohexylmethyl) adipate, exo-2,3-epoxynorbornane, bis (3, 4epoxy-6-methylcyclohexylmethyl) adipate, 2-(7-oxabicyclo[4.1.0]hept-3-yl)-spiro(1,3-dioxane-5,3'-[7]oxabicyclo[4.1.0]heptane, 4-(1'-methylepoxyethyl)-1,2-epoxy-2-methylcyclohexane, 4-epoxyethyl-1,2-epoxycyclohexane.

Specific examples of (vii) epoxidized fatty acid monoesters include esters of epoxidized fatty acids of 12–20 carbons and alcohols of 1–8 carbons, phenols or alkylphenols. Particularly preferred for use are butyl, hexyl, benzyl, cyclohexyl, methoxyethyl, octyl, phenyl and butylphenyl esters of epoxystearic acid.

Specific examples of (viii) epoxidized vegetable oils include epoxy compounds of vegetable oils such as soybean oil, linseed oil and cottonseed oil.

Among the aforementioned epoxy compounds, phenylglycidyl ether epoxy compounds, glycidyl ester epoxy compounds, alicyclic epoxy compounds and epoxidized fatty acid monoesters are preferred for further improved heat and hydrolytic stability, with glycidyl ester epoxy compounds and alicyclic epoxy compounds being even more preferred.

When these epoxy compounds are incorporated in a refrigerant oil composition according to the invention, there are no particular restrictions on their addition content but the epoxy compound is added to a content of preferably 0.1–5.0% by mass and more preferably 0.2–2.0% by mass, based on the total amount of the refrigerating machine oil composition (the total amount of the base oil and all incorporated additives).

Two or more different types of the aforementioned phosphorus compounds and epoxy compounds may, of course, be used in combination.

In order to further improve performance, the refrigerating machine oil composition of the invention may be incorporated, as required, with hitherto publicly known additives for refrigerating machine oils, for example, phenol-type antioxidants such as di-tert-butyl-p-cresol and bisphenol A; amine-type antioxidants such as phenyl-α-naphthylamide and N,N-di(2-naphthyl)-p-phenylenediamine; wear resistance agents such as zinc dithiophosphate; extreme pressure agents such as chlorinated paraffin and sulfur compounds; oiliness improvers such as fatty acids; antifoaming agents such as silicone types; metal inactivators such as benzotriazole; viscosity index improvers; pour-point depressants; detergent dispersants and the like, either alone or in combinations of more than one type. The total amount of the additives added into the refrigerating machine oil is not particularly limited, but in general the content is preferably not more than 10% by mass and more preferably not more than 5% by mass, of the total amount of the refrigerating machine oil composition (i.e., the total amount of the base oil and all incorporated additives).

There are no particular restrictions on the kinematic viscosity of the refrigerating machine oil composition of the invention, and the kinematic viscosity at 40° C. may be within a range of 3 to 500 $mm^2/s$, more preferably 4 to 400 $mm^2/s$ and most preferably 5 to 300 $mm^2/s$. Further, the kinematic viscosity at 100° C. may be within a range of 1 to 50 $mm^2/s$, more preferably 1.5 to 40 $mm^2/s$, and most preferably 2 to 30 $mm^2/s$.

Also, the volume resistivity of the refrigerating machine oil composition of the invention is not particularly limited, but is preferably at least $1.0\times10^{11}$ Ω·cm, more preferably at least $1.0\times10^{12}$ Ω·cm and most preferably at least $1.0\times10^{13}$ Ω·cm. Particularly, when the refrigerating machine oil composition is used for a hermetic type refrigerating machine, a high electric insulating property tends to be requisite. According to the present invention, the volume resistivity is represented by the value [Ω·cm] at 25° C. measured in accordance with JIS C 2101 "Electric Insulating Oil Testing Method."

The moisture content of the refrigerating machine oil composition of the invention is not particularly limited, but is preferably no greater than 200 ppm, more preferably no greater than 100 ppm, and most preferably no greater than 50 ppm, of the total amount of the refrigerating machine oil composition. A low moisture content is particularly required when the refrigerating machine oil composition is used for a hermetic type refrigerating machine, because of its effects on the heat and hydrolytic stability and the electric insulating property of the oil.

The total acid value of the refrigerating machine oil composition of the invention is also not particularly limited, but when the oil composition is used in a refrigerating machine or in pipes to prevent metals from corrosion, the total acid value is preferably no greater than 0.1 mgKOH/g, and more preferably no greater than 0.05 mgKOH/g. According to the invention, the total acid value is represented as the total acid value measured in accordance with JIS K 2501 "Petroleum Products and Lubricating Oils—Neutralization Value Testing Method".

The ash content of the refrigerating machine oil composition of the invention is not particularly limited, but in order to improve the heat and hydrolytic stability of the oil and reduce generation of sludge and the like, it is preferably no greater than 100 ppm, and more preferably no greater than 50 ppm. According to the invention, the ash content is represented by the ash content value [ppm] as measured in accordance with JIS K 2272 "Testing Method for Ash Content and Sulfuric Acid Ash Content in Crude Oils and Petroleum Products".

Refrigerants that may be used in refrigerating machines that employ refrigerating machine oil compositions according to the invention include HFC refrigerants, fluorine-containing ether refrigerants such as perfluoroethers; fluorine-free ether refrigerants such as dimethyl ethers; and natural refrigerants such as carbon dioxide, hydrocarbons and the like, and these refrigerants can be used alone or in combinations including two or more kinds of the refrigerants.

As HFC refrigerants there may be mentioned hydrofluorocarbons having 1–3 and preferably 1 or 2 carbon atoms. Specific examples include HFCs such as difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a), 1,1,1-trifluloroethane (HFC-143a), 1,1-difluoroethane (HFC-152a), and mixtures of two or more kinds of these HFCs. The refrigerant is selected in accordance with the intended use and the required performance, and as preferred examples there may be mentioned HFC-32 alone; HFC-23 alone; HFC-134a alone; HFC-125 alone; a mixture of HFC-134a/HFC-32=60–80% by mass/40–20% by mass; a mixture of HFC-32/HFC-125=40–70% by mass/60–30% by mass; a mixture of HFC-125/HFC-143a=40–60% by mass/60–40% by mass; a mixture of HFC-134a/HFC-32/HFC-125=60% by mass/30% by mass/10% by mass; a mixture of HFC-134a/HFC-32/HFC-125=40–70% by mass/15–35% by mass/5–40% by mass; and a mixture of HFC-125/HFC-134a/HFC-143a=35–55% by mass/1–15% by mass/40–60% by mass. More specific examples include a mixture of HFC-134a/HFC-32=70/30% by mass; a mixture of HFC-32/HFC-125=60/40% by mass; a mixture of HFC-32/HFC-125=50/50% by mass (R410A); a mixture of HFC-32/HFC-125=45/55% by mass (R410B); a mixture of HFC-125/HFC-143a=50/50% by mass (R507C); a mixture of HFC-32/HFC-125/HFC-134a=30/10/60% by mass; a mixture of HFC-32/HFC-125/HFC-134a=23/25/52% by mass (R407C); a mixture of HFC-32/HFC-125/HFC(-134a=25/15/60%, by mass (R407E); and a mixture of HFC-125/HFC-134a/HFC-143a=44/4/52% by mass (R404A).

Examples of natural refrigerants include carbon dioxide, hydrocarbons and the like. A hydrocarbon refrigerant referred to here is preferably a gas at 25° C. under 1 atm. Specifically such gases include alkanes, cycloalkanes and alkenes of 1 to 5 carbons and preferably 1 to 4 carbons, as well as mixtures thereof. Specific examples of such hydrocarbon refrigerants include methane, ethylene, ethane, propylene, propane, cyclopropane, butane, isobutane (i-butane), cyclobutane, methylcyclopropane and mixtures of two or more of these compounds. Propane, butane, isobutane and mixtures thereof are preferred among these.

The refrigerating machine oil composition of the invention normally exists in the form of a refrigerating machine fluid composition mixed with a refrigerant as describe above when it is used in the refrigerating machine. The mixing ratio of the refrigerating machine oil composition to the refrigerant is not particularly limited, but the amount of the refrigerating machine oil composition is preferably within a range of 1 to 500 parts by weight and more preferably within a range of 2 to 400 parts by weight to 100 parts by weight of the refrigerant.

The refrigerating machine oil composition of the invention can be used as a lubricating oil for refrigerant compressors in all types of refrigerating machines, because of its excellent electric properties and low hygroscopicity. The refrigerating machines in which the composition may be used include, specifically, an air conditioner for rooms, an package air conditioners, a cold-storage chest (refrigerator), an automotive air conditioner, a dehumidifier, a freezer, a freeze and refrigeration warehouse, an automatic vending machine, a showcase, a cooling apparatuses in chemical plants, etc. The refrigerating machine oil composition of the invention is most preferably used in refrigerating machines equipped with hermetic compressors. The refrigerating machine oil composition of the invention may be used with all types of compressors including reciprocating types, rotary types and centrifugal types.

The construction of the preferred refrigerating cycle in which the composition of the invention is used will typically be equipped with a compressor, a condenser, an expander and an evaporator, and if necessary a drier.

The compressor may be, for example, a high-pressure container-system compressor wherein a motor comprising a rotator and a stator, a rotating shaft fitted in the rotator, and a compressor section connected to the motor are housed in a sealed container holding a refrigerating machine oil, and high-pressure refrigerant gas ejected from the compressor section is collected in the sealed container, or a low-pressure container-system compressor wherein a motor comprising a rotator and a stator, a rotating shaft fitted in the rotator, and a compressor section connected to the motor are housed in a sealed container holding a refrigerating machine oil, and high-pressure refrigerant gas ejected from the compressor section is directly ejected out of the sealed container.

An insulating film used as the electric insulating system material for the motor section may be a crystalline plastic film with a glass transition point of 50° C. or higher, specific preferred examples of which include one or more types of insulating films selected from the group consisting of polyethylene terephthalate, polybutylene terephthalate, polyphenylene sulfide, polyether-ether-ketone, polyethylene naphthalate, polyamideimide and polyimide, or composite films prepared by laminating high glass transition point resin layers on low glass transition point films, because of their resistance to deterioration in tensile strength and electric insulating property. The magnet wire which is used for the motor section is preferably one with an enamel coating having a glass transition point of 120° C. or higher, such as a monolayer of a polyester, polyester imide, polyamide or polyamideimide, or an enamel coating which is a composite coating of a high glass transition point upper layer on a low glass transition point underlayer. As composite coated enamel wires there may be mentioned those with a polyamideimide upper layer coated on a polyester imide underlayer (AI/EI), and those with a polyamideimide upper layer coated on a polyester underlayer (AI/PE.) The drying agent packed in the drier is preferably synthetic zeolite comprising an alkali metal silicate/aluminate compound salt with a carbon dioxide gas absorption volume of no greater than 1.0% at a pore size of 3.3 Angstroms or smaller and a carbon dioxide gas partial pressure of 250 mmHg at 25° C. Specific examples include the trade names XH-9, XH-10, XH-11 and XH-600 by Union Showa Co., Ltd.

EXAMPLES

The present invention will now be explained in further detail by way of examples and comparative examples, with the understanding that the invention is in no way limited thereby.

Examples 1–14 and Comparative Examples 1–2

Sample oils were prepared for Examples 1–14 and Comparative Examples 1–2, using each of the following base oils and additives combined in the mixing ratios shown in Tables 1 to 4. The properties of each of the obtained sample oils (kinematic viscosity at 40° C. and 100° C., total acid value) are shown in Tables 1–4.

(Alicyclic Polycarboxylic Acid Ester Compounds)

The alicyclic polycarboxylic acid ester compounds for Examples 1–14 were obtained using the compounds listed below as compounds (a), (b) arid (c) (components (c-I) and (c-II)), in the mixing ratios listed in Tables 1 to 3. All of the alicyclic polycarboxylic acid esters used contained compounds represented by formulas (A) to (E). Tables 1 to 3 show the compositions of compounds (A) to (E) for each of the examples. In Tables 1 to 3, E (c-I, c-I) represents a compound wherein both of the two $R^2$ groups of compound (E) are alkyl groups derived from component (c-I), E (c-I, c-II) represents a compound wherein one of the two $R^2$ groups of compound (E) is an alkyl group derived from component (c-I) and the other is an alkyl group derived from component (c-II), and E (c-II, c-II) represents a compound wherein both of the two $R^2$ groups of compound (E) are alkyl groups derived from component (c-II).

Compound (a)

1: 4-cyclohexene-1,2-dicarboxylic acid

2: 1,2-cyclohexanedicarboxylic acid

Compound (b)

b-1: ethylene glycol b-2: propylene glycol b-3: dipropylene glycol b-4: butylene glycol Compound (c-I)

c-I-1: iso-butylalcohol

Compound (c-II)

c-II-1: 2-ethylhexanol c-II-2: 3,5,5-trimethylhexanol (Other Base Oils)

Base oil 1: Ester obtained using mixture of pentaerythritol and mixed acid of 2-ethylhexanoic acid and 3,5,5-trimethylhexanoic acid (mixing ratio: 50/50 (by weight))

Base oil 2: Copolymer of vinyl ethyl ether and vinyl butyl ether (average molecular weight: 900, ethyl/butyl molar ratio: 7/1)

Base oil 3: Ester obtained using 4-cyclohexene-1,2-dicarboxylic acid and 2-ethylhexanoic Base oil 4: Ester obtained using 4-cyclohexene-1,2-dicarboxylic acid and iso-butanol (Additives)

Additive 1: Glycidyl-2,2-dimethyloctanoate

Additive 2: Cyclohexene oxide

Additive 3: Tricresyl phosphate

The following tests were then carried out for each of the sample oils of Examples 1–14 and Comparative Examples 1–2.

(Refrigerant Miscibility Test)

The refrigerant miscibility of each of the sample oils was evaluated in accordance with the "Refrigerant Miscibility Testing Method" of JIS-K-2211 "Refrigerating machine oils", using HFC-134a or R410A (HFC-32/HFC-125=50/50% by mass mixture) as the refrigerant. Specifically, 10 g of each of the sample oils was blended with 40 g of the refrigerant and upon gradually lowering the temperature from 20° C. to −70° C., the temperature at which separation or turbidity occurred was recorded. The results are shown in Tables 1 to 4. In Tables 1 to 4, "<−70" indicates that no separation or turbidity was exhibited even when the temperature was lowered to −70° C., while ">20" indicates that separation or turbidity was already exhibited at the initial measuring temperature (20° C.).

(Insulating Property Test)

The volume resistivity of each of the sample oils at 25° C. was measured in accordance with JIS-C-2101 "Electric Insulating Oil Testing Method." The results are shown in Tables 1 to 4.

(Heat/Hydrolytic Stability Test)

A 90 g portion of each of the sample oils prepared with a moisture content of 500 ppm was weighed out into an autoclave which was sealed after addition of 10 g of HFC134a refrigerant and catalysts (iron, copper and aluminum wires), and then the autoclave was heated at 175° C. for 3 weeks and the total acid value of each sample oil was measured. The results are shown in Tables 1 to 4.

(Lubricity Test)

A test machine was operated at a test oil temperature of 100° C. under a load of 150 lb for 1 minute and then under a load of 250 lb for 2 hours, in accordance with ASTM D 2670, "FALEX WEAR TEST". The degree of wear of the test journal (pin) after the test was measured for each sample oil. The results are shown in Tables 1 to 4.

TABLE 1

| | | | | Example 1 | Example 2 | Example 3 | Example 4 | Example 5 |
|---|---|---|---|---|---|---|---|---|
| Composition | Alicyclic polycarboxylic acid ester compound (mol %) | | | 100 | 100 | 100 | 100 | 100 |
| | Charged composition (molar ratio) | (a) | a-1 | 100 | 100 | 100 | 100 | 100 |
| | | | a-2 | — | — | — | — | — |
| | | (b) | b-1 | 15 | 20 | — | — | — |
| | | | b-2 | — | — | 15 | — | — |
| | | | b-3 | — | — | — | 15 | 15 |
| | | | b-4 | — | — | — | — | — |
| | | (c-I) | c-I-1 | 70 | 60 | 35 | 35 | 35 |
| | | (c-II) | c-II-1 | — | — | 35 | 35 | — |
| | | | c-II-2 | — | — | — | — | 35 |
| | Composition of (A)–(E) (mol %) | | (A) | 14 | 18 | 8 | 15 | 10 |
| | | | (B) | 3 | 9 | 20 | 8 | 7 |
| | | | (C) | 30 | 30 | 28 | 22 | 25 |
| | | | (D) | 6 | 9 | — | 3 | 1 |
| | | (E) | E (c-I, c-I) | 47 | 34 | 6 | 10 | 16 |
| | | | E (c-I, c-II) | — | — | 27 | 23 | 26 |
| | | | E (c-II, c-II) | — | — | 11 | 19 | 15 |
| | Other base oils (mol %) | | Base oil 1 | — | — | — | — | — |
| | | | Base oil 2 | — | — | — | — | — |
| | | | Base oil 3 | — | — | — | — | — |
| | | | Base oil 4 | — | — | — | — | — |
| | Additives (mol %) | | Additive 1 | — | — | — | — | — |
| | | | Additive 2 | — | — | — | — | — |
| | | | Additive 3 | — | — | — | — | — |
| Kinematic viscosity ($mm^2/s$) | | | 40° C. | 38.6 | 70.9 | 56.3 | 44.1 | 62.3 |
| | | | 100° C. | 4.7 | 6.4 | 6.4 | 5.6 | 6.9 |
| Total acid value (mgKOH/g) | | | | 0.00 | 0.00 | 0.00 | 0.00 | 0.00 |
| Turbidity or separation temperature in miscibility test (° C.) | | | HFC-134a | <−70 | <−70 | −42 | −30 | −41 |
| | | | R410A | <−70 | <−70 | −23 | 2 | −31 |
| Volume resistivity (Ω · cm) | | | | $2.7 \times 10^{13}$ | $3.1 \times 10^{13}$ | $1.2 \times 10^{13}$ | $3.3 \times 10^{13}$ | $4.6 \times 10^{13}$ |
| Total acid value after heat/hydrolytic stability test (mgKOH/g) | | | | 0.94 | 0.85 | 0.79 | 0.32 | 0.38 |
| Wear in lubricity test (mg) | | | | 24 | 22 | 25 | 19 | 18 |

TABLE 2

| | | | | Example 6 | Example 7 | Example 8 | Example 9 | Example 10 |
|---|---|---|---|---|---|---|---|---|
| Composition | Alicyclic polycarboxylic acid ester compound (mol %) | | | 100 | 100 | 100 | 100 | 99.5 |
| | Charged composition (molar ratio) | (a) | a-1 | — | — | — | 100 | 100 |
| | | | a-2 | 100 | 100 | 100 | — | — |
| | | (b) | b-1 | — | — | — | — | 20 |
| | | | b-2 | — | — | — | — | — |
| | | | b-3 | 10 | 15 | 10 | — | — |
| | | | b-4 | — | — | — | 15 | — |
| | | (c-I) | c-I-1 | 52 | 35 | 40 | 35 | 60 |
| | | (c-II) | c-II-1 | 28 | — | — | 35 | — |
| | | | c-II-2 | — | 35 | 40 | — | — |

TABLE 2-continued

| | | | Example 6 | Example 7 | Example 8 | Example 9 | Example 10 |
|---|---|---|---|---|---|---|---|
| Composition of (A)–(E) (mol %) | | (A) | 8 | 12 | 8 | 13 | 18 |
| | | (B) | 5 | 7 | 4 | 6 | 9 |
| | | (C) | 17 | 21 | 18 | 20 | 30 |
| | | (D) | — | 2 | — | — | 9 |
| | (E) | E (c-I, c-I) | 36 | 11 | 27 | 13 | 34 |
| | | E (c-I, c-II) | 24 | 26 | 28 | 15 | — |
| | | E (c-II, c-II) | 10 | 21 | 15 | 23 | — |
| Other base oils (mol %) | | Base oil 1 | — | — | — | — | — |
| | | Base oil 2 | — | — | — | — | — |
| | | Base oil 3 | — | — | — | — | — |
| | | Base oil 4 | — | — | — | — | — |
| Additives (mol %) | | Additive 1 | — | — | — | — | 0.5 |
| | | Additive 2 | — | — | — | — | — |
| | | Additive 3 | — | — | — | — | — |
| Kinematic viscosity ($mm^2/s$) | | 40° C. | 26.3 | 60.4 | 36.0 | 45.9 | 70.1 |
| | | 100° C. | 4.1 | 6.8 | 5.1 | 5.6 | 6.3 |
| Total acid value (mgKOH/g) | | | 0.00 | 0.00 | 0.00 | 0.00 | 0.00 |
| Turbidity or separation temperature in miscibility test (° C.) | | HFC-134a | −64 | −51 | −51 | −19 | <−70 |
| | | R410A | −40 | −32 | −28 | 5 | <−70 |
| Volume resistivity (Ω · cm) | | | $2.8 \times 10^{13}$ | $4.4 \times 10^{13}$ | $4.5 \times 10^{13}$ | $1.3 \times 10^{13}$ | $3.0 \times 10^{13}$ |
| Total acid value after heat/hydrolytic stability test (mgKOH/g) | | | 0.29 | 0.34 | 0.59 | 0.63 | 0.00 |
| Wear in lubricity test (mg) | | | 26 | 24 | 25 | 22 | 22 |

TABLE 3

| | | | Example 11 | Example 12 | Example 13 | Example 14 |
|---|---|---|---|---|---|---|
| Composition | Alicyclic polycarboxylic acid ester compound (mol %) | | 99.5 | 98.5 | 50 | 50 |
| | Charged composition (molar ratio) (a) | a-1 | 100 | 100 | 100 | 100 |
| | | a-2 | — | — | — | — |
| | (b) | b-1 | — | — | — | — |
| | | b-2 | — | — | 15 | — |
| | | b-3 | 15 | 15 | — | 15 |
| | | b-4 | — | — | — | — |
| | (c-I) | c-I-1 | 35 | 35 | 35 | 35 |
| | (c-II) | c-II-1 | 35 | 35 | 35 | — |
| | | c-II-2 | — | — | 35 | — |
| | Composition of (A)–(E) (mol %) | (A) | 15 | 15 | 8 | 10 |
| | | (B) | 8 | 8 | 20 | 7 |
| | | (C) | 22 | 22 | 28 | 25 |
| | | (D) | 3 | 3 | — | 1 |
| | (E) | E (c-I, c-I) | 10 | 10 | 6 | 16 |
| | | E (c-I, c-II) | 23 | 23 | 27 | 26 |
| | | E (c-II, c-II) | 19 | 19 | 11 | 15 |
| | Other base oils (mol %) | Base oil 1 | — | — | 50 | — |
| | | Base oil 2 | — | — | — | 50 |
| | | Base oil 3 | — | — | — | — |
| | | Base oil 4 | — | — | — | — |
| | Additives (mol %) | Additive 1 | — | 0.5 | — | — |
| | | Additive 2 | 0.5 | — | — | — |
| | | Additive 3 | — | 1.0 | — | — |
| Kinematic viscosity ($mm^2/s$) | | 40° C. | 43.3 | 43.0 | 62.2 | 65.6 |
| | | 100° C. | 5.5 | 5.5 | 7.3 | 7.6 |
| Total acid value (mgKOH/g) | | | 0.00 | 0.00 | 0.00 | 0.00 |
| Turbidity or separation temperature in miscibility test (° C.) | | HFC-134a | −30 | −30 | −29 | −41 |
| | | R410A | 2 | 2 | −10 | −33 |
| Volume resistivity (Ω · cm) | | | $2.9 \times 10^{13}$ | $3.1 \times 10^{13}$ | $9.3 \times 10^{13}$ | $3.5 \times 10^{13}$ |
| Total acid value after heat/hydrolytic stability test (mgKOH/g) | | | 0.00 | 0.00 | 0.48 | 0.29 |
| Wear in lubricity test (mg) | | | 19 | 8 | 22 | 28 |

TABLE 4

| | | | | Comp. Ex.1 | Comp. Ex.2 |
|---|---|---|---|---|---|
| Composition | Alicyclic polycarboxylic acid ester compound (mol %) | | | 0 | 0 |
| | Charged composition (molar ratio) | (a) | a-1 | — | — |
| | | | a-2 | — | — |
| | | (b) | b-1 | — | — |
| | | | b-2 | — | — |
| | | | b-3 | — | — |
| | | | b-4 | — | — |
| | | (c-I) | c-I-1 | — | — |
| | | (c-II) | c-II-1 | — | — |
| | | | c-II-2 | — | — |
| | Composition of (A)–(E) (mol %) | | (A) | — | — |
| | | | (B) | — | — |
| | | | (C) | — | — |
| | | | (D) | — | — |
| | | (E) | E (c-I, c-I) | — | — |
| | | | E (c-I, c-II) | — | — |
| | | | E (c-II, c-II) | — | — |
| | Other base oils (mol %) | | Base oil 1 | — | — |
| | | | Base oil 2 | — | — |
| | | | Base oil 3 | 100 | — |
| | | | Base oil 4 | — | 100 |
| | Additives (mol %) | | Additive 1 | — | — |
| | | | Additive 2 | — | — |
| | | | Additive 3 | — | — |
| Kinematic viscosity ($mm^2/s$) | | | 40° C. | 16.5 | 9.1 |
| | | | 100° C. | 3.3 | 2.1 |
| Total acid value (mgKOH/g) | | | | 0.00 | 0.00 |
| Turbidity or separation temperature in miscibility test (° C.) | | | HFC-134a | >20 | <−70 |
| | | | R410A | >20 | <−70 |
| Volume resistivity (Ω · cm) | | | | $3.5 \times 10^{13}$ | $3.4 \times 10^{11}$ |
| Total acid value after heat/hydrolytic stability test (mgKOH/g) | | | | 0.29 | 1.52 |
| Wear in lubricity test (mg) | | | | 28 | 30 |

As clearly shown by the results in Tables 1 to 3, the sample oils of Examples 1 to 14 representing refrigerating machine oil composition according to the invention were confirmed to have a satisfactory balance between refrigerant miscibility, electric insulating property, hydrolytic stability, heat stability and lubricity when used together with the HFC refrigerants, even when the viscosity was high. Furthermore, the sample oils of Examples 10 to 12 employing epoxy compounds as additives exhibited even higher heat and hydrolytic stability, while the sample oil of Example 12 employing a phosphorus compound exhibited even higher lubricity.

In contrast, as shown in Table 4, the sample oil of Comparative Example 1 exhibited insufficient refrigerant miscibility, despite its lower viscosity compared to the sample oils of Examples 1 to 14. The sample oil of Comparative Example 2 exhibited insufficient heat and hydrolytic stability.

INDUSTRIAL APPLICABILITY

As explained above, refrigerating machine oil composition according to the present invention can be used together with HFC refrigerants and natural refrigerants such as carbon dioxide and hydrocarbons, to provide a satisfactory balance between all of the properties of lubricity, miscibility with refrigerants, heat and hydrolytic stability and electric insulating property.

What is claimed is:

1. A refrigerating machine oil composition comprising an alicyclic polycarboxylic acid ester compound comprising:

(a) an alicyclic polycarboxylic acid having an alicyclic ring and two or more carboxyl groups, or its derivative, wherein at least two of the carboxyl groups are bonded to mutually adjacent carbon atoms on the alicyclic ring;

(b) a first compound with two or more hydroxyl groups or its derivative; and (c) a second compound with one hydroxyl group or its derivative.

2. A refrigerating machine oil composition according to claim 1, wherein the number of carboxyl groups is 2, and the number of hydroxyl groups is 2.

3. A refrigerating machine oil composition according to claim 1, wherein compound (c) is a mixture of at least one type of monohydric alcohol selected from the group consisting of aliphatic monohydric alcohols of 1–5 carbons and at least one type of monohydric alocohol selected from the group consisting of aliphatic monohydric alcohols is 6–18 carbons.

4. A refrigerating machine oil composition according to claim 1, which further comprises at least one selected from the group consisting of phosphoric acid esters, acidic phosphoric acid esters, amine salts of acidic phosphoric acid ester, chlorinated phosphoric acid esters and phosphorous acid esters.

5. A refrigerating machine oil composition according to claim 1, which further comprises at least one selected from the group consisting of phenylglycidyl ether-type epoxy compounds, alkylglycidyl ether-type epoxy compounds, glycidyl ester-type epoxy compounds, allyloxirane compounds, alkyloxirane compounds, alicyclic epoxy compounds, epoxidized fatty acid monoesters and epoxidized vegetable oils.

* * * * *